US009145800B2

(12) United States Patent
Hentsch et al.

(10) Patent No.: US 9,145,800 B2
(45) Date of Patent: Sep. 29, 2015

(54) SEALING DEVICE AND CAMSHAFT ADJUSTER

(71) Applicant: Hilite Germany GmbH, Marktheidenfeld (DE)

(72) Inventors: Florian Hentsch, Wendlingen (DE); Stefanie Hutzelmann, Gräfendorf (DE); Robert Schaaf, Stuttgart (DE); Dietmar Schulze, Münzenberg (DE)

(73) Assignee: HILITE GERMANY GMBH (DE)

( * ) Notice: Subject to any disclaimer, the term of this patent is extended or adjusted under 35 U.S.C. 154(b) by 0 days.

(21) Appl. No.: 14/135,070

(22) Filed: Dec. 19, 2013

(65) Prior Publication Data

US 2014/0230764 A1 Aug. 21, 2014

(30) Foreign Application Priority Data

Feb. 21, 2013 (DE) ..... 10 2013 101 737

(51) Int. Cl.

| | |
|---|---|
| ***F01L 1/34*** | (2006.01) |
| ***F01L 1/344*** | (2006.01) |
| ***F01L 1/02*** | (2006.01) |

(52) U.S. Cl.

CPC ..... *F01L 1/3442* (2013.01); *F01L 1/024* (2013.01); *F01L 2001/34433* (2013.01); *F01L 2001/34479* (2013.01)

(58) Field of Classification Search

CPC ..... F01L 1/3442; F01L 1/024; F01L 2001/34433; F01L 2001/34479

USPC ..... 123/90.15, 90.17

See application file for complete search history.

(56) References Cited

U.S. PATENT DOCUMENTS

| | | | | |
|---|---|---|---|---|
| 7,025,023 | B2 * | 4/2006 | Lehmann et al. | 123/90.17 |
| 7,308,876 | B2 * | 12/2007 | Schafer et al. | 123/90.17 |

FOREIGN PATENT DOCUMENTS

| | | | |
|---|---|---|---|
| DE | 10 2008 051 145 | A1 | 4/2010 |
| EP | 0 518 529 | A1 | 12/1992 |
| WO | WO 2012171670 | A1 * | 12/2012 |

* cited by examiner

*Primary Examiner* — Ching Chang

(74) *Attorney, Agent, or Firm* — Clark Hill PLC

(57) ABSTRACT

A sealing device (12) for a camshaft adjuster (1) which is driveable using a belt and has a distributing valve (8) with a piston, wherein the sealing device (12) has a first securing portion (13) rigidly arrangeable on the camshaft adjuster (1), a second securing portion (14) rigidly arrangeable on the piston side, and a flexible membrane portion (15) arranged between the first securing portion (13) and the second securing portion (14), and a camshaft adjuster (1) having a having a stator (3) which, based on a combustion engine, is driveable using a belt, and a rotor (4) with limited twistability relative to the stator (3), wherein a twisting can be effected hydraulically, and a distributing valve (8) with a piston for the purpose of freeing up or blocking the pathway for a hydraulic medium or altering a through-flow direction, wherein the camshaft adjuster (1) has a sealing device (12) of the type whose first securing portion (13) is rigidly arranged on the camshaft adjuster (1) and whose second securing portion (14) is rigidly arranged on the piston side.

20 Claims, 1 Drawing Sheet

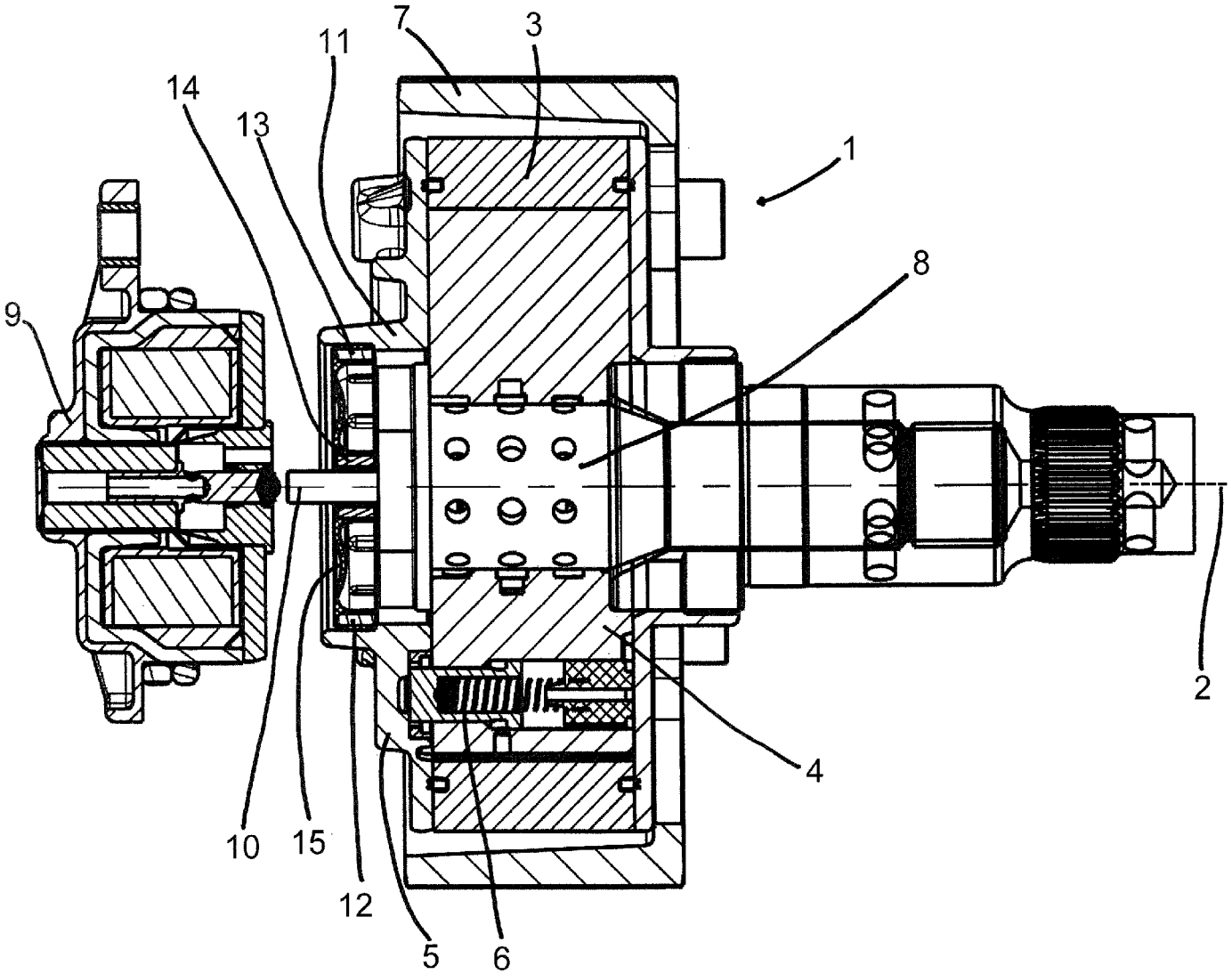
1
2
3
4
5
6
7
8
9
10
11
12
13
14
15

SEALING DEVICE AND CAMSHAFT ADJUSTER

RELATED/PRIORITY APPLICATION

This application relies upon German Application No. 10 2013 101 737.1, filed on Feb. 21, 2013, for priority.

[The] invention relates to a sealing device for a camshaft adjuster, which is driveable using a belt and has a distributing valve with a piston, and a camshaft adjuster having a stator driveable—originating from a combustion engine—using a belt, and a rotor with limited twistability relative to the stator, wherein a twisting is effected hydraulically, and a distributing valve with a piston for the purpose of freeing up or blocking the pathway for a hydraulic medium or altering a through-flow direction.

From DE 10 2008 051 145 A1, a camshaft adjuster is known having a belt drive for a combustion engine comprising a stator driven by the crankshaft of the combustion engine via a belt, a rotor non-rotatably connected to the camshaft, working chambers impingeable with an oil pressure and arranged between the stator and the rotor, which are subdivided by vanes associated with the rotor into mutually opposing pressure chambers, in which camshaft adjuster, to control the oil pressure in the pressure chambers of the working chambers, a central valve having a piston guided within the central valve and longitudinally displaceable is provided, which piston is impingeable with a force from a drive side of the camshaft adjuster by an actuator, and the camshaft adjuster has, on its drive side, a seal which prevents the oil flow from emerging into the structural space accommodating the belt drive, in order to create a camshaft adjuster having a belt drive the oil flow of which is driven via a central valve.

In accordance with DE 10 2008 051 145 A1, the seal may be formed by a bellows seal which, with its radially outer margin, is rigidly connected to the camshaft adjuster, and centrally is connected to a part which is associated with the piston and with which the actuator is in contact.

The underlying aim of the invention is to effect a structural and/or functional improvement of a sealing device mentioned in the introduction and of a camshaft adjuster mentioned in the introduction. In particular, structural complexity and financial outlay should be reduced. In particular, operational reliability should be increased. In particular, the need for maintenance should be reduced. In particular, impermeability should be increased. In particular, ability to withstand pressure should be increased.

The aim is achieved with a sealing device for a camshaft adjuster, which is driveable using a belt and has a distributing valve with a piston, wherein the sealing device has a first securing portion rigidly arrangeable on the camshaft adjuster, a second securing portion rigidly arrangeable on the piston side, and a flexible membrane portion arranged between the first securing portion and the second securing portion.

The camshaft adjuster may have a belt-drive region and a valve region. A belt drive may be arranged within the belt-drive region. The distributing valve may be arranged within the valve region. The valve region may be impinged upon with a hydraulic medium. The belt drive region and the valve region may be separated from one another by a housing-like wall portion. The camshaft adjuster may have an actuator to operate the distributor valve. The actuator may be arranged outside the valve region. The distributor valve may be actuable from outside the valve region. The sealing device may be arranged on the wall portion separating the belt-drive region and the valve region. The sealing device can serve to separate the belt-drive region and the valve region from one another in order to prevent undesirable through-passage of hydraulic medium from the valve region to the belt-drive region.

The sealing device may have an annular shape with an outer margin and an inner margin. The first securing portion may be arranged on the outer margin. The second securing portion may be arranged on the inner margin. The membrane portion may be elastic. The membrane portion may exhibit an elastomeric material. The membrane portion may exhibit an oil-resistant material. The membrane portion may exhibit a plastics material.

The sealing device may be designed without full-thickness connecting sites. The sealing device may be designed without external connecting sites. The sealing device may exhibit a fixed outer ring and a fixed inner ring. The outer ring and the inner ring may be substantially more rigid than the membrane portion. The outer ring and the inner ring may each exhibit a metallic or duroplastic material. The outer ring and the inner ring may be connected to the membrane portion in an injection-moulding process. The outer ring and the inner ring may be injected around or injected in. The membrane portion may have a bead-like shape.

The underlying aim of the invention is also achieved with a camshaft adjuster having a having a stator which, based on a combustion engine, is driveable using a belt, and a rotor with limited twistability relative to the stator, wherein a twisting can be effected hydraulically, and a distributing valve with a piston for the purpose of freeing up or blocking the pathway for a hydraulic medium or altering a through-flow direction, wherein the camshaft adjuster has a sealing device of the type whose first securing portion is rigidly arranged on the camshaft adjuster and whose second securing portion is rigidly arranged on the piston side.

The combustion engine may have a drive shaft, such as a crankshaft. The combustion engine may have at least one camshaft. The combustion engine may have valves. The camshaft may serve to operate the valves. The combustion engine may serve to drive a motor vehicle. The camshaft adjuster may serve for arrangement in a valve drive of the combustion engine between the output shaft and a camshaft. The camshaft adjuster may serve for regulation of a relative rotational position between an output shaft and a camshaft of a combustion engine. The camshaft adjuster may serve for phase displacement of the camshaft. The camshaft adjuster may serve to adjust control times.

The stator and the rotor may be rotatable together. The rotor may be connectable with the camshaft of the combustion engine. The rotor may be rotatable relative to the stator between a first end position and a second end position. The stator may have a housing-like form. The stator may have radially inwards-directed vanes. The rotor may have radially outwards-directed vanes. The vanes of the state and the vanes of the rotor may engage into one another. Pressure chambers may be formed between the vanes of the stator and the vanes of the rotor. The pressure chambers may be impingeable with a hydraulic medium for regulating the camshaft adjuster. The distributing valve may serve for adjustment control.

The sealing device may be pressed into the camshaft adjuster with its first securing portion and on the piston side, be pressed on with its second securing portion. The camshaft adjuster and the distributor valve piston may be pre-mounted in the first instance and the sealing device subsequently pressed into place.

The camshaft adjuster may have a locking disc, and the first securing portion of the locking device can be pressed into the locking disc, The locking disc may be connected, in particular screwed, to the stator of the camshaft adjuster. The locking disc may have a disc-like form with an outer margin and an inner margin. On the inner margin, the locking disc may have a tube butt-like prolongation. The first securing portion of the sealing device may be pressed into the prolongation of the locking disc. Axially on the outside, the sealing device may be covered with a covering element.

That camshaft adjuster may have a piston pin movement-transmittingly connected to the piston, and the second securing portion of the sealing device may be pressed onto the piston pin. The piston pin may be of a structurally separate design from the piston. The piston pin may be designed in one piece with the piston. The piston pin may pass through the sealing device and be mechanically impingeable using an actuator. With the aid of the actuator, the piston pin may be impingeable with a force of pressure. A bearing, for example, a ball bearing, may be arranged between the actuator and the piston pin.

To summarise, and in other words, the invention therefore results, inter alia, in a membrane seal. A functionality of the membrane can comprise the following: sealing tightness towards the outside; piston-pin guide member (binding member between central valve and actuator); piston pin pressed into membrane; membrane pressed into the locking disc.

The word "may" designates in particular optional features of the invention. Consequently, a single embodiment of the invention represents the particular feature or features.

With the invention, structural complexity and financial outlay are reduced. The sealing device has a simplified structure. The sealing device requires reduced use of materials. Operational reliability is increased. Full-thickness and/or external connecting sites on the sealing device are avoided. The need for maintenance is reduced. Narrow areas, on which undesirable deposits can form, are avoided. Sealing-tightness is increased. Ability to withstand pressure is increased relative to materials used.

In what follows, an embodiment of the invention will be described in greater detail with reference to a diagram. This description brings to light further features and advantages. Concrete features of this embodiment may represent general features of the invention. Features of this embodiment connected to other features may also represent individual features of the invention.

The figure shows, in diagrammatic form and by way of example, a camshaft adjuster driveable using a belt, which camshaft adjuster has a distributing valve with a piston, and a sealing device.

The camshaft adjuster 1 serves for arrangement within a valve drive of a combustion engine between a crankshaft and a camshaft. The camshaft serves for actuation of inlet valves and/or outlet valves of the combustion engine. With the aid of the camshaft adjuster 1, a rotational position of the camshaft relative to the crankshaft can be adjusted. By this means, control times can be adjusted. The camshaft adjuster 1 may be adjusted within an adjustment range between an early setting, in which valves of the combustion engine are actuated early relative to the crankshaft, and a late setting, in which valves of the combustion engine are actuated late relative to the crankshaft.

The camshaft adjuster 1 has an axis of rotation 2. The crankshaft adjuster 1 has a stator 3 and a rotor 4. The stator 3 and the rotor 4 are rotatable together about the axis of rotation 2 and have limited twistability relative to one another.

The stator 3 forms a housing of the camshaft adjuster 1. The stator 3 has a pulley 5. The pulley 5 serves for driving the camshaft adjuster 1 on the basis of the crankshaft of the combustion engine using a belt. The rotor 4 is non-rotatably connectable to a camshaft.

The stator 3 has vanes extending radially inwards from an annular portion. The rotor 4 has vanes extending radially outwards. The stator 3 and the rotor 4 engage into one another with their vanes. Pressure chambers are formed between the vanes of the stator 3 and of the rotor 4. The pressure chambers can be impinged upon with hydraulic oil to effect twisting of the stator 3 and of the rotor 4 relative to one another. In this process, the stator 3 and the rotor 4 can be twisted relative to one another in both directions of rotation between a first end position and a second end position. In the end positions, the vanes of the stator 3 and the vanes of the rotor 4 are each in interlocking contact with one another.

The stator 3 has a locking disc 5. The locking disc 5 is arranged on a side of the camshaft adjuster 1 facing away from the camshaft. A locking pin 6, which can engage into the locking disc 5 in a locking position, is arranged on the latter in order to block relative rotate ability of the stator 3 and the rotor 4. The stator 3 has a pulley 7. The pulley 7 effects driving of the camshaft adjuster 1 by means of a belt, the drive originating from the combustion engine. The pulley 7 has a belt-bearing surface arranged radially on the outside. The belt-bearing surface and the belt are arranged within a belt-drive region. In order to ensure drive in an operationally reliable manner, the belt-drive region should be kept free from hydraulic oil.

The camshaft adjuster 1 has a distributing valve 8. The distributing valve 8 serves to free up or block a pathway for hydraulic oil or to alter its through-flow direction, in order to impinge upon the pressure chambers of the camshaft adjuster 1 with hydraulic oil as necessary. The distributing valve 8 is arranged within a valve region. The valve region is impinged upon with hydraulic oil. The distributing valve 8 has a piston. To actuate the distributing valve 8, the piston is displaceable in the direction of extent of the axis of rotation 2. An actuator 9 serves to displace the piston. With the aid of the actuator 9, the piston is impingeable with a force of pressure. Return positioning of the piston is effected using a spring. A piston pin 10 is arranged between the piston and the actuator 9. The piston pin 10 serves for power/motion transmission between the actuator 9 and the piston.

The locking disc 5 has a central opening limited by an inner margin 11 continued outwards in the manner of a tube butt. The piston pin 10 extends outwards towards the actuator 9 through the opening of the locking disc 5. A membrane seal 12 serves for sealed guide-through of the piston pin 10.

The membrane seal 12 has an annular disc-shaped form having an outer margin 13 and an inner margin 14. Between the outer margin 13 and the inner margin 14, the membrane seal 12 has a membrane portion 15. The membrane seal 12 with the membrane portion 15 is manufactured from an elastomer and oil-resistant plastic in an injection operation. During this process, a metallic ring is introduced by injection in each case radially towards the outside and radially towards the inside. With its outer margin 13, the membrane seal 12 is pressed into the opening of the locking disc 5. With its inner margin 14, the membrane seal 12 is pressed onto the piston pin 10. By this means, the membrane seal 12 seals the hydraulic oil-impinged valve region.

The inner margin 14 of the of the membrane seal 12, is rigidly arranged on the piston pin 10, while the outer margin 13 of the membrane seal 12 is rigidly arranged on the locking disc 5. During displacement of the piston pin 10 in the direction of extent of the axis of rotation 2, the inner margin 14 and the outer margin 13 thus move relative to one another. Between the outer margin 13 and the inner margin 14 on the one hand, and the locking disc 5 and piston pin 10 on the other, there is no relative movement. The membrane portion 15 forms a circumferential bead of the membrane seal 12. Thereby is moveability ensured. The membrane portion 15 exhibits no folds. This prevents undesirable deposits. Wear is reduced.

Key

1 Camshaft adjuster
2 Axis of rotation
3 Stator
4 Rotor
5 Locking disc
6 Locking pin
7 Pulley
8 Distributing valve
9 Actuator
10 Piston pin
11 Inner margin
12 Membrane seal
13 Outer margin
14 Inner margin
15 Membrane portion

The invention claimed is:

1. A sealing device (12) for a camshaft adjuster (1), which is driveable using a belt and has a distributing valve (8) with a piston, characterised in that the sealing device (12) has a first securing portion (13) rigidly arrangeable on the camshaft adjuster (1), a second securing portion (14) rigidly arrangeable on a piston side, and a flexible membrane portion (15) arranged between the first securing portion (13) and the second securing portion (14).

2. A sealing device (12) according to claim 1, characterised in that the sealing device (12) has a fixed outer ring and a fixed inner ring.

3. A sealing device (12) according to claim 2, characterised in that the membrane portion (15) has a bead shape.

4. A camshaft adjuster (1) according to claim 2, characterised in that the sealing device (12) is pressed into the camshaft adjuster with its first securing portion (13) and on the piston side is pressed on with its second securing portion (14).

5. A camshaft adjuster (1) according to claim 2, characterised in that the camshaft adjuster (1) has a locking disc (5) and the first securing portion (13) of the sealing device (12) is pressed into the locking disc (5).

6. A camshaft adjuster (1) according to claim 2, characterised in that the camshaft adjuster (1) has a piston rod (10) movement-transmittingly connected to the piston, and the second securing portion of the sealing device (12) is pressed onto a piston rod (10).

7. A sealing device (12) according to claim 2, characterised in that the outer ring and the inner ring are connected to the flexible membrane portion (15) in an injection moulding process.

8. A sealing device (12) according to claim 7, characterised in that the membrane portion (15) has a bead shape.

9. A camshaft adjuster (1) according to claim 7, characterised in that the sealing device (12) is pressed into the camshaft adjuster with its first securing portion (13) and on the piston side is pressed on with its second securing portion (14).

10. A sealing device (12) according to claim 1, characterised in that the flexible membrane portion (15) has a bead shape.

11. A camshaft adjuster (1) according to claim 10, characterised in that the sealing device (12) is pressed into the camshaft adjuster with its first securing portion (13) and on the piston side is pressed on with its second securing portion (14).

12. A camshaft adjuster (1) having a stator (3) which, based on a combustion engine, is driveable using a belt, and a rotor (4) with limited twistability relative to the stator (3), wherein a twisting is effected hydraulically, and a distributing valve (8) with a piston for the purpose of freeing or blocking the path of a hydraulic medium or altering a through-flow direction, characterised in that the camshaft adjuster (1) has a sealing device (12) according to at least one of the preceding claims, the first securing portion (13) of which is rigidly arranged on the camshaft adjuster (1) and the second securing portion (14) of which is rigidly arranged on the piston side.

13. A camshaft adjuster (1) according to claim 12, characterised in that the sealing device (12) is pressed into the camshaft adjuster with its first securing portion (13) and on the piston side is pressed on with its second securing portion (14).

14. A camshaft adjuster (1) according to claim 12, characterised in that the camshaft adjuster (1) has a locking disc (5) and the first securing portion (13) of the sealing device (12) is pressed into the locking disc (5).

15. A camshaft adjuster (1) according to claim 12, characterised in that the camshaft adjuster (1) has a piston rod (10) movement-transmittingly connected to the piston, and the second securing portion of the sealing device (12) is pressed onto the piston rod (10).

16. A camshaft adjuster (1) according to claim 12, characterised in that a piston rod (10) passes through the sealing device (12) and is mechanically impingable using an actuator (9).

17. A camshaft adjuster (1) according to claim 1, characterised in that the sealing device (12) is pressed into the camshaft adjuster with its first securing portion (13) and on the piston side is pressed on with its second securing portion (14).

18. A camshaft adjuster (1) according to claim 1, characterised in that the camshaft adjuster (1) has a locking disc (5) and the first securing portion (13) of the sealing device (12) is pressed into the locking disc (5).

19. A camshaft adjuster (1) according to claim 1, characterised in that the camshaft adjuster (1) has a piston rod (10) movement-transmittingly connected to the piston, and the second securing portion of the sealing device (12) is pressed onto a piston rod (10).

20. A camshaft adjuster (1) according to claim 1, characterised in that a piston rod (10) passes through the sealing device (12) and is mechanically impingable using an actuator (9).

* * * * *